US007703161B1

(12) United States Patent
Handshaw

(10) Patent No.: US 7,703,161 B1
(45) Date of Patent: Apr. 27, 2010

(54) VEHICLE EXTRICATION PREPARATORY TOOL

(76) Inventor: Darran Michael Handshaw, 92 Lt. Peter C Martin Dr., Miller Place, NY (US) 11764

( * ) Notice: Subject to any disclaimer, the term of this patent is extended or adjusted under 35 U.S.C. 154(b) by 0 days.

(21) Appl. No.: 11/824,638

(22) Filed: Jul. 2, 2007

(51) Int. Cl.

| | |
|---|---|
| ***B26B 11/00*** | (2006.01) |
| ***A47G 21/04*** | (2006.01) |
| ***B25D 1/04*** | (2006.01) |
| ***B26B 3/06*** | (2006.01) |
| ***F41B 13/02*** | (2006.01) |
| ***F41C 27/18*** | (2006.01) |
| *B25F 1/04* | (2006.01) |

(52) U.S. Cl. ..... 7/158; 7/110; 7/144; 30/155

(58) Field of Classification Search ..... 7/158, 7/110, 144, 161, 169; 30/155
See application file for complete search history.

(56) References Cited

U.S. PATENT DOCUMENTS

| | | | | | |
|---|---|---|---|---|---|
| 854,891 | A | * | 5/1907 | Huffman | 7/168 |
| 1,530,688 | A | * | 3/1925 | Murray | 7/158 |
| 2,576,869 | A | * | 11/1951 | Woltemath | 30/166.3 |
| 3,219,316 | A | * | 11/1965 | Fried | 254/131 |
| 3,623,173 | A | * | 11/1971 | Hagqvist | 7/145 |
| 3,705,430 | A | * | 12/1972 | Ziaylek, Jr. | 7/147 |
| 3,837,023 | A | * | 9/1974 | Spencer-Foote | 7/145 |
| 4,124,939 | A | * | 11/1978 | Onoue | 30/161 |
| 4,287,623 | A | * | 9/1981 | Tarran | 7/158 |
| 4,506,445 | A | * | 3/1985 | Esten | 30/228 |
| 4,985,954 | A | * | 1/1991 | Wehr | 7/144 |
| 5,088,174 | A | * | 2/1992 | Hull et al. | 29/254 |
| 5,103,520 | A | * | 4/1992 | Mazzo | 7/104 |
| 5,315,725 | A | * | 5/1994 | Vanden Heuvel | 7/145 |
| 5,465,490 | A | * | 11/1995 | Smith et al. | 30/180 |
| 5,542,139 | A | * | 8/1996 | Boivin | 7/118 |
| 5,878,478 | A | * | 3/1999 | Hasegawa | 29/525.01 |
| 5,996,235 | A | * | 12/1999 | Brainerd | 30/308.1 |
| 6,079,071 | A | * | 6/2000 | Sablan et al. | 7/144 |
| D429,987 | S | * | 8/2000 | Hung | D8/105 |
| 6,318,218 | B1 | * | 11/2001 | Anderson et al. | 81/440 |
| 6,453,564 | B1 | * | 9/2002 | Foley | 30/359 |
| 6,941,791 | B1 | * | 9/2005 | Sanders et al. | 72/458 |
| 7,225,544 | B2 | * | 6/2007 | Petzl | 30/381 |
| D551,529 | S | * | 9/2007 | Youngren et al. | D8/75 |

* cited by examiner

*Primary Examiner*—Joseph J Hail, III
*Assistant Examiner*—Alvin J Grant
(74) *Attorney, Agent, or Firm*—Mark Levy; Hinman, Howard & Kattell

(57) ABSTRACT

A vehicle extrication preparatory tool includes an elongated body portion with an ergonomic bend in the middle. A handle is provided forward of the bend extending in an upward direction perpendicularly to the rear section of the body. Incorporated into the upward end of the handle is a window punch. A pry bar is attached to the rearward end of the body portion. Incorporated into the forward end of the tool is a swivel segment. The swivel segment incorporates both a windshield spike and a windshield saw blade. In the open position, the saw blade extends from the swivel segment, running parallel with the front section of the body and the spike extends upward from the swivel segment perpendicular to the rear section of the body. When closed, the saw blade fits inside a slot in the body portion extending from the swivel segment inline with the front section of the body and the spike extends downward perpendicular to the rear section of the body from the swivel segment.

10 Claims, 2 Drawing Sheets

VEHICLE EXTRICATION PREPARATORY TOOL

FIELD OF THE INVENTION

This invention relates to emergency rescue equipment and, more particularly, to a vehicle extrication preparatory tool for preparing a vehicle for extrication of occupants thereof.

BACKGROUND OF THE INVENTION

There are many different tools needed to prepare a crashed vehicle for patient extrication. Many times these tools become misplaced or lost at an emergency scene. Rifling through the tools can also be time consuming and might mean the difference between saving and losing a life. Some of these tools are also unreliable at times and this also causes a considerable problem when time is of the essence.

Motor vehicle windshields generally are made from glass and plastic laminates. The plastic laminates prevent the glass laminates, which may shatter in an accident, from flying apart and injuring the vehicle occupants.

The side and rear windows of the vehicle are usually made of tempered glass which shatters into small flakes.

In a motor vehicle accident, the driver and/or passengers is/are sometimes trapped inside the vehicle. In situations such as this, battery cables must be cut to protect the occupants of the vehicle from further injury from malfunctioning electrical systems. Frequently, patient extrication requires the removal of the vehicle top to evacuate and treat the injured driver and/or passengers. Before the vehicle top can be removed, the windshield and the side and rear windows frequently have to be removed and the seatbelts must be cut. Of course, during the process of window and top removal, occupants are covered, typically with protective blankets. Access to a trapped patient in a vehicle must be made with the least amount of movement of the vehicle possible to reduce the chance of further injury, particularly neck and spine injury, to the patient. When the patient's legs are trapped beneath the vehicle dashboard, the dash must be pushed up off of the legs so that the patient can be removed. In order for the hydraulic spreaders to properly grip the vehicle, the rubber and plastic linings of the door frame must be removed.

Tools frequently used by emergency medical personnel under such circumstances include axes, hay hooks, pneumatic hammers, glass saws, window punches, pry bars, cable cutters and seat belt cutters. These tools are used in collaboration to prepare the car for heavy rescue extrication. Many of these tools can be lost or misplaced on a chaotic emergency scene and using such a wide assortment of tools can take precious time. The axe is a rather crude tool for windshield removal. Care must be taken to prevent the axe head from entering the vehicle passenger compartment to reduce the risk of greater injury to the driver and front seat passenger. The force required to be exerted on the hay hook to remove the windshield tends to move the vehicle. As previously stated, moving the vehicle is risky and is to be avoided to reduce the risk of further neck/spine injury to the vehicle occupants. Air hammers can cause small glass fragments to fly around uncontrollably, placing not only the occupants, but also their rescuers at risk of further injury.

Many existing glass saws have an exposed blade that can put rescuers at risk of being cut when the saw is not being used, or when a spike on the saw is being used to start the cut and the exposed blade is facing the rescuer. The window punch often consists of a spring-loaded center punch that has questionable reliability, often with a malfunctioned spring mechanism. The window punch, seatbelt cutters, and cable cutters are also often very small and can be easily misplaced.

SUMMARY OF THE INVENTION

It is an object of this invention to provide a tool that will permit the preparation of a vehicle that has been involved in a motor vehicle accident for the extrication of a patient. This preparation takes place in a manner that is safer for the rescuers and patients as well as faster and more reliable than existing solutions. The tool provides apparatus for removing laminated glass windshields, removing the tempered glass of side and rear windows, removing the rubbers and plastics lining the door frames and window frames and cutting the battery cables and seatbelts. These functions are provided in a single functional tool that can be used by a single rescuer and does not have fragmentary parts that may be lost in a chaotic emergency scene.

The vehicle extrication preparatory tool incorporates the functions of many tools into one solitary form that is suitable for preparing a motor vehicle for extrication. The preparatory functions presented in this invention include: a laminated glass spike which is a device used to initially pierce the laminated glass used mostly in vehicle windshields and the side and rear windows of newer and more expensive vehicles. The main purpose of this spike is to provide a starting point for the windshield saw to begin cutting the laminated glass. A laminated glass saw is a device used to saw through the laminated glass of a vehicle's windshield quickly and smoothly. The laminated glass saw and spike will assist in removal of laminated glass to allow patient extrication or roof removal. A tempered glass punch which is a heat treated center punch or a circular spike used to instantly shatter a tempered glass window by applying a large amount of force over a pinpoint area. The tempered glass punch is intended to break this tempered glass normally used in a vehicle's side and rear windows. A pry bar is a device used to remove excess plastic or rubber that lines the door and window frames of the car so that the extrication hydraulic tools can gain a solid purchase point without slipping. A set of cable cutters can quickly and easily slice through the battery cables of a vehicle to protect against accidental airbag deployment during heavy rescue operations. The device may also be used to cut through the cable bundle that runs out of the main body of the car and into each of the doors as well. This will assist in removal of the doors and ultimately patient extrication. The cable cutters can also function as a seatbelt cutter to assist in patient extrication or to allow roof or post removal. The vehicle extrication preparatory tool solves these issues by incorporating all of these tools into a single tool that performs all of their functions, while keeping the safety of the rescuer and patients in mind.

According to the invention, a vehicle extrication preparatory tool includes an elongated body portion with an ergonomic bend in the middle with a handle is provided forward of the bend that extends in an upward direction perpendicularly to the rear section of the body.

Illustratively, incorporated into the upward end of the handle is a window punch, incorporated into the rearward end of the body portion is a pry bar, and incorporated into the forward end of the tool is a swivel segment.

Further illustratively, the swivel segment incorporates both a windshield spike and a windshield saw blade. In the open position, the saw blade extends from the swivel segment, running parallel with the front section of the body and the spike extends upward from the swivel segment perpendicular to the rear section of the body. When closed, the saw blade fits inside a slot in the body portion extending from the swivel segment inline with the front section of the body and the spike extends downward perpendicular to the rear section of the body from the swivel segment.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE PREFERRED EMBODIMENT

Figure 1:
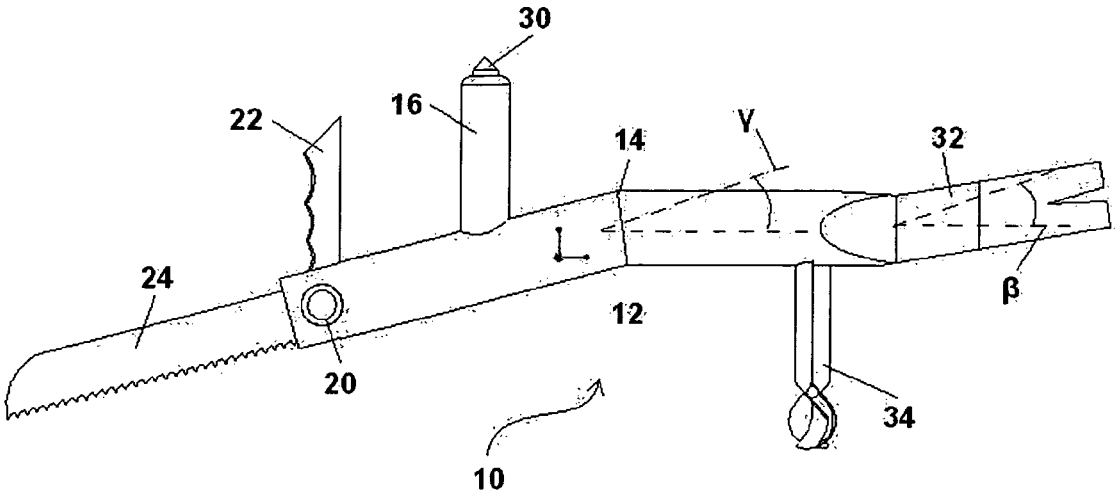
FIG. 1 illustrates a perspective view of a tool constructed according to the invention.

Referring to FIG. 1, a vehicle extrication preparatory tool 10 includes a 1.65 in (4.19 cm) diameter cylindrical cross section tubular main body 12 with an ergonomic bend 14 in the middle at angle θ of about 10°-20°. Illustratively, main body portion 12 is about 15 in (38.1 cm) long. Additionally, a 0.75 in (1.91 cm) diameter cylindrical cross section tubular handle 16 is attached to the forward section of main body 12 generally perpendicular to the rear section of main body 12.

Loosely fit into the forwardmost part of main body 12 is a swivel segment 20 consisting of a 0.88 in (2.24 cm) diameter tube of cylindrical cross section. Furthermore, attached to the swivel segment 20 is a windshield spike 22 and a windshield saw blade 24.

Figure 2:
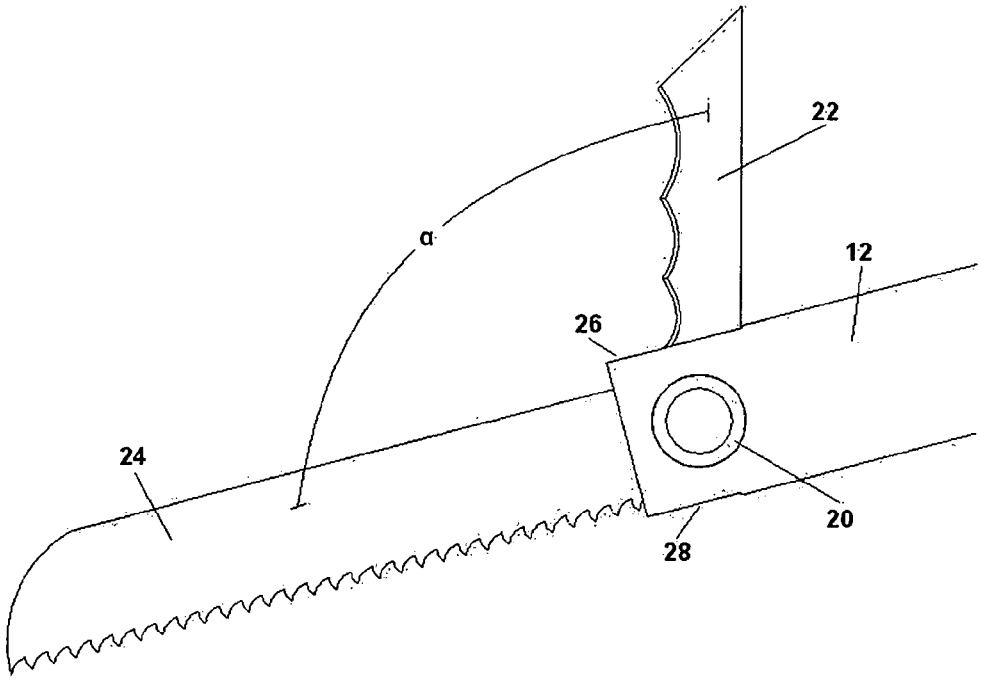
FIG. 2 illustrates a detailed perspective view of the swivel mechanism of the tool seen in FIG. 1.

FIG. 2 displays a closer view of the swivel feature of the vehicle extrication preparatory tool 10. This feature includes the swivel segment 20 attached to which is the windshield saw blade 24 and the windshield spike 22 with angle α of about 90°-105° between them. Also shown is a slot 26 that allows reception of windshield spike 22 as well as a slot 28 that allows reception of windshield saw blade 24 into the body.

Figure 3:
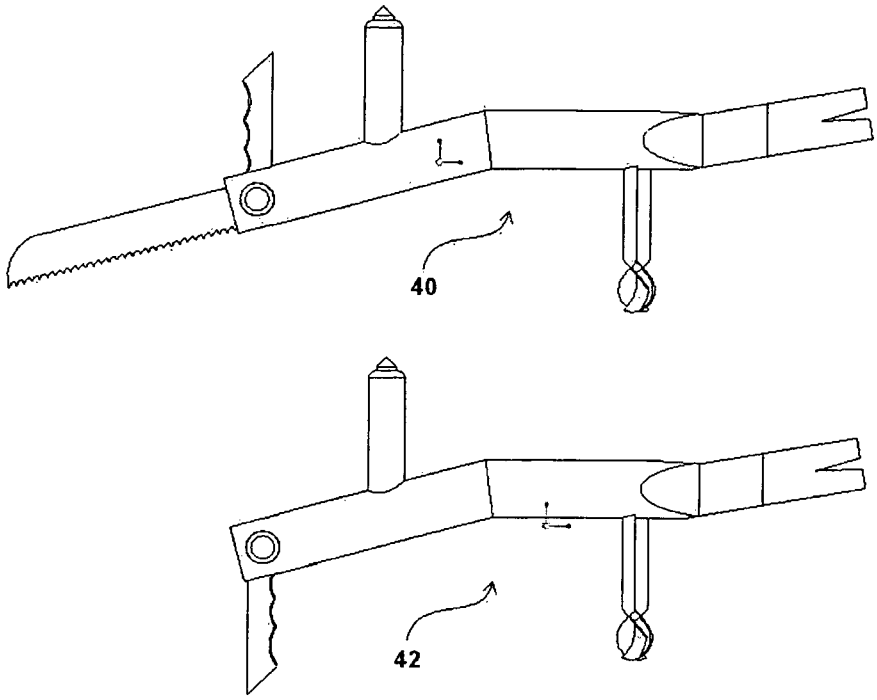
FIG. 3 illustrates two different modes of operation of the invention.
Figure 4:
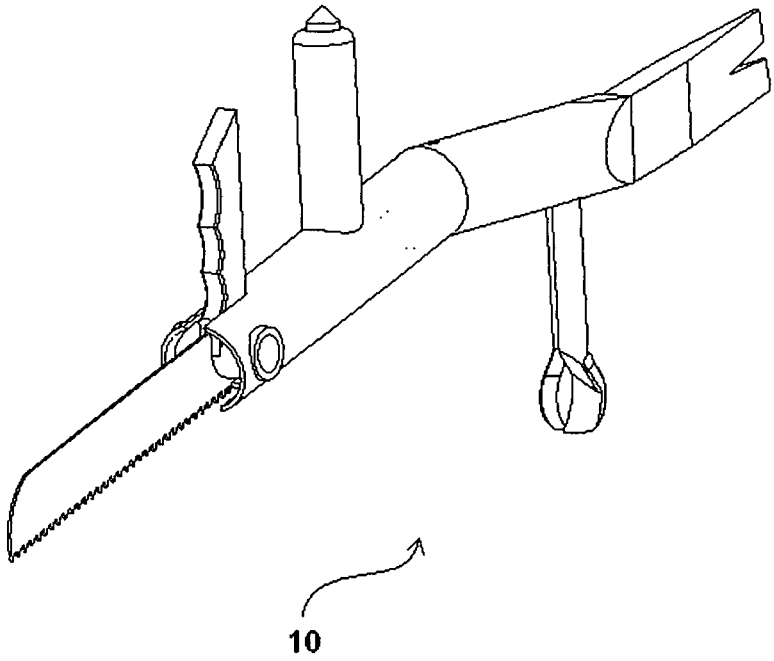
FIG. 4 illustrates an additional perspective view of the invention.

Referring to FIG. 3, views of the vehicle extrication preparatory tool 10 are shown for both the open position 40 and the closed position 42. In the open position 40, the saw blade 24 extends from the swivel segment 20, running parallel with the front section of the body portion 12 and the spike 22 extends upward from the swivel segment 20 perpendicular to the rear section of body portion 12 fitting into a slot 26 cut into main body 12. In the closed position 42, the saw blade 24 extends from the swivel segment 20 inline with the front section of the body portion 12 fitting inside a slot 28 cut into the main body 12 and the spike 22 extends downward perpendicular to the rear section of body portion 12 from the swivel segment 20. The saw blade 24 and the spike 22 are both welded to the swivel segment 20 at an angle α of about 90°-105°. Alternatively, the saw blade 24 can be clamped in place to swivel segment 20, thereby allowing it to be replaced.

A window punch 30 is pressed into the upward end of cylindrical handle 16. Prying segment 32 is welded to the rearward end of the body portion 12 extending out at angle β of about 0°-15° in the rearward direction. Cable cutter mechanism 34 is welded rearward of the bend of the body portion 12 extending in a downward direction perpendicular to the rear section of the body portion 12. An alternative design does not contain cable cutter mechanism 34.

Since other modifications and changes varied to fit particular operating requirements and environments will be apparent to those skilled in the art, the invention is not considered limited to the examples chosen for purposes of disclosure and covers all changes and modifications which do not constitute departures from the true spirit and scope of this invention.

Having thus described the invention, what is desired to be protected by Letters Patent is presented in the subsequently appended claims.

What is claimed is:

1. A vehicle extraction preparatory tool comprising: an elongated body having a rear section and a forward end having a distal end at the extremity thereof and having an ergonomic bend in the middle; a handle having a distal end, and a proximal end connected to the body between the ergonomic bend and the distal end of said forward end of the ergonomic bend, said handle extending upwardly, substantially perpendicular to the rear section of the body; a pry bar attached to the rear section of the body; a swivel segment attached to the forward end of the body, a laminated glass saw connected to said swivel segment and having a spike attached thereto; and a window punch stationarily affixed to the distal end of said handle.

2. The apparatus of claim 1, wherein the swivel segment is free to rotate about an axis in the forward end of the body, said swivel section adapted to extend to the right and left of the tool.

3. The apparatus of claim 2, wherein said windshield saw extends generally in line with the forward end of the body when in the open position.

4. The apparatus of claim 3, wherein the body contains a slot for accepting the windshield saw therein.

5. The apparatus of claim 4, wherein the windshield saw is rotatable about the swivel segment to be housed inside the body.

6. The apparatus of claim 2, wherein the forward end of the body portion contains a slot allowing the acceptance of the spike in the first and second directions generally.

7. The apparatus of claim 6, wherein the spike extends generally perpendicular to the rear section of the body in a substantially upward direction when in the open position.

8. The apparatus of claim 4, wherein the spike can be rotated in a downward direction when in the closed position.

9. The apparatus of claim 1, wherein a pry bar is attached to the rearward end of the body portion extending generally in line with the rear section of the body portion in a rearward direction.

10. The apparatus of claim 1, further comprising a cable cutter attached rearward of the bend of the body extending in a downward direction substantially perpendicular to the rear section thereof.

* * * * *